US012239174B2

(12) United States Patent
Shi

(10) Patent No.: US 12,239,174 B2
(45) Date of Patent: Mar. 4, 2025

(54) TECHNICALLY IMPROVED MEDICAL PROTECTIVE CLOTHING

(71) Applicant: WUXI CENTER FOR DISEASE CONTROL AND PREVENTION, Wuxi (CN)

(72) Inventor: Chao Shi, Wuxi (CN)

(73) Assignee: WUXI CENTER FOR DISEASE CONTROL AND PREVENTION, Wuxi (CN)

( * ) Notice: Subject to any disclaimer, the term of this patent is extended or adjusted under 35 U.S.C. 154(b) by 66 days.

(21) Appl. No.: 18/107,857

(22) Filed: Feb. 9, 2023

(65) Prior Publication Data

US 2023/0248090 A1 Aug. 10, 2023

(30) Foreign Application Priority Data

Feb. 10, 2022 (CN) ..... 202210125400.X

(51) Int. Cl.
*A41D 13/12* (2006.01)

(52) U.S. Cl.
CPC ..... *A41D 13/1218* (2013.01)

(58) Field of Classification Search
CPC ..... A41D 13/0155; A41D 13/002; A41D 13/0025; A41D 13/12; A41D 13/1209; A41D 13/1218; A41D 13/1227
See application file for complete search history.

(56) References Cited

U.S. PATENT DOCUMENTS 2,495,316 A * 1/1950 Clark ..... B64D 10/00 600/20
7,735,156 B2 * 6/2010 VanDerWoude ..... A42B 3/225 2/410
7,832,396 B2 * 11/2010 Abernethy ..... A62B 17/006 128/202.19
8,800,068 B2 * 8/2014 Liu ..... A62B 17/00 2/457

(Continued)

FOREIGN PATENT DOCUMENTS

CN 107006945 A 8/2017
CN 109528462 U 3/2019

(Continued)

OTHER PUBLICATIONS

First Office Action for Chinese Application No. 202210125400.X, dated Jun. 16, 2022, 16 Pages (including English Translation).

(Continued)

*Primary Examiner* — F Griffin Hall
(74) *Attorney, Agent, or Firm* — BROOKS KUSHMAN P.C.

(57) ABSTRACT

Medical protective clothing, including a protective clothing body. The protective clothing body includes a hood part, a neck part, a top, pants, shoe cover parts, and sleeves, and is formed by sewing the hood part, the neck part, the top, the pants, the shoe cover parts and the sleeves in sequence. The hood part includes an air exchange assembly. The sidewall of the top is separated from the back of the medical personnel by means of airbag ribs, thus preventing the sweaty back from being in contact with the sidewall of the top to make the people feel uncomfortable when the protective clothing is worn for a long time in summer.

1 Claim, 5 Drawing Sheets

(56) References Cited

U.S. PATENT DOCUMENTS

| | | | | |
|---|---|---|---|---|
| 10,195,468 | B2 * | 2/2019 | Allan | A62B 17/006 |
| 10,687,568 | B2 * | 6/2020 | Pavalarajan | H04L 25/4908 |

FOREIGN PATENT DOCUMENTS

| | | | | |
|---|---|---|---|---|
| CN | 209965265 | U | | 1/2020 |
| CN | 111838799 | U | | 10/2020 |
| CN | 211882373 | U | * | 11/2020 |
| CN | 112602973 | A | * | 4/2021 |
| CN | 113598731 | A | * | 11/2021 |
| CN | 114668199 | A | * | 6/2022 |

OTHER PUBLICATIONS

Second Office Action for Chinese Application No. 202210125400.X, dated Jul. 14, 2022, 15 Pages (including English Translation).

* cited by examiner

TECHNICALLY IMPROVED MEDICAL PROTECTIVE CLOTHING

CROSS-REFERENCE TO RELATED APPLICATIONS

This application claims foreign priority benefits under 35 U.S.C. § 119(a)-(d) to Chinese Patent Application No. 202210125400.X, filed on Feb. 10, 2022, which is hereby incorporated herein by reference in its entirety.

TECHNICAL FIELD

The present disclosure relates to the technical field of medical protective clothing, and in particular relates to technically improved medical protective clothing.

BACKGROUND

During epidemic, the medical personnel need to wear protective clothing for more than ten hours a day, but the existing protective clothing has several shortcomings: it is easy to generate fog at the head part after the protective clothing is worn for a long time; due to the high temperature environment in summer, the protective clothing clinging to the medical personnel makes the body hotter; moreover, prolonged standing make the legs of the medical personnel sore, which may affect the normal work of the medical personnel in severe cases, and if the medical personnel just sit to rest for a while, their legs cannot get the complete rest.

In order to solve the problems above, the present disclosure provides technically improved medical protective clothing.

SUMMARY (1) The technical problem to be solved is as follows:

To overcome the shortcomings in the prior art to meet the actual needs, an objective of the present disclosure is to provide technically improved medical protective clothing to solve the above technical problems.

(2) The technical solutions are as follows:

To achieve the objective of the present disclosure, the technical solutions adopted by the present disclosure are as follows:

Technically improved medical protective clothing comprises a protective clothing body. The protective clothing body comprises a hood part, a neck part, a top, pants, shoe cover parts, and sleeves, and is formed by sewing the hood part, the neck part, the top, the pants, the shoe cover parts and the sleeves in sequence. The hood part is provided with an air exchange assembly. The hood part, the top and the pants are provided with a sealing zipper. A transparent mask is buckled in the hood part, a heating wire is fixedly arranged at the inner side of the hood, and a battery is fixedly arranged at the inner side of the hood part. The battery is connected to the heating wire by a wire; the left side and the right side of the pants are respectively provided with a massage assembly and a conversion assembly. The top is provided with a supporting assembly, and the bottom of the each shoe cover part is provided with a power assembly.

The power assembly comprises a first airbag, and the first airbag is fixedly arranged at the bottom of the shoe cover part.

The supporting assembly is provided with a ventilation cavity and an air inlet, and comprises airbag ribs. The ventilation cavity is located at the sidewalls of the shoe cover part, the pants and the top. The air inlet is located at the bottom of the shoe cover part and communicates with the ventilation cavity. The airbag ribs are located at the inner side of the top and communicate with the ventilation cavity.

The number of the airbag ribs is three, and the three airbag ribs are arranged along the height of the top.

The massage assembly comprises a connecting plate fixedly arranged at a shank side of the pants, and the connecting plate is provided with an inner cavity and a plurality of holes. The plurality of holes are arranged in a height direction of the connecting plate and communicate with the inner cavity. A massage protruding block capable of hermetically moving back and forth is arranged in each hole; and the inner cavity and the ventilation cavity are provided with a first connecting hose in a communicating manner.

One end, facing the pants, of the massage protruding block is circular arc.

The conversion assembly comprises a second airbag fixedly arranged at a hip side of the pants, a fixing pipe is fixedly arranged at a heel side of the shoe cover part, and a push block capable of moving back and forth is arranged in the fixing pipe. A spring is fixedly arranged between the push block and the sidewall of the fixing pipe, and a second connecting hose is arranged between the fixing pipe and the inner cavity in a communicating manner.

Rubber is fixedly arranged on one side face, facing the shoe cover part, of the push block.

The air exchange assembly comprises a filtering housing fixed at the back side of head of the hood part, and an antivirus filter screen is fixedly arranged in the filtering housing. An air intake pump is fixedly arranged at the back side of head of the hood part, and a third connecting hose is arranged between the air intake pump and the inside of the filtering housing in a communicating manner. An air intake pipe is arranged on the air intake pump in a communicating manner. A fourth connecting hose is arranged between the inside of the hood part and the inside of the filtering housing in a communicating manner. The top part is provided with two air outlets, and automatic air exchange valves are fixedly arranged at the air outlets.

(3) The beneficial effects are as follows:

A. In accordance with the present disclosure, the sidewall of the top 4 is separated from the back of the medical personnel by the airbag ribs 133, thus preventing the medical personnel from feeling hotter due to the fact that the protective clothing clings to the medical personnel when the protective clothing is worn for a long time in summer. When needing to sit on a chair to rest, the medical personnel can put both hands on a chair seat to upward the front ends of the feet, thus the first airbags 141 at the middle of the feet are off the ground to remove the air from the airbag ribs 133 and deflate the airbag ribs 133; and then the medical personnel can sit on the chair with the back clinging to the chair, and can sit comfortably.

B. When sitting on the chair, the medical personnel can press and hold the connecting plates with both hands, and then can continuously step on the ground by both feet to make the first airbags 141 be deflated after continuously making contact with the ground, thus the air can enter the inner cavity 111 through the second connecting hose to push massage protruding blocks to massage the legs.

C. The electric heating wire is provided to prevent the transparent mask from fogging to affect the line of sight, and the battery may employ a small flat battery to power the electric heating wire.

DETAILED DESCRIPTION

Figure 1:
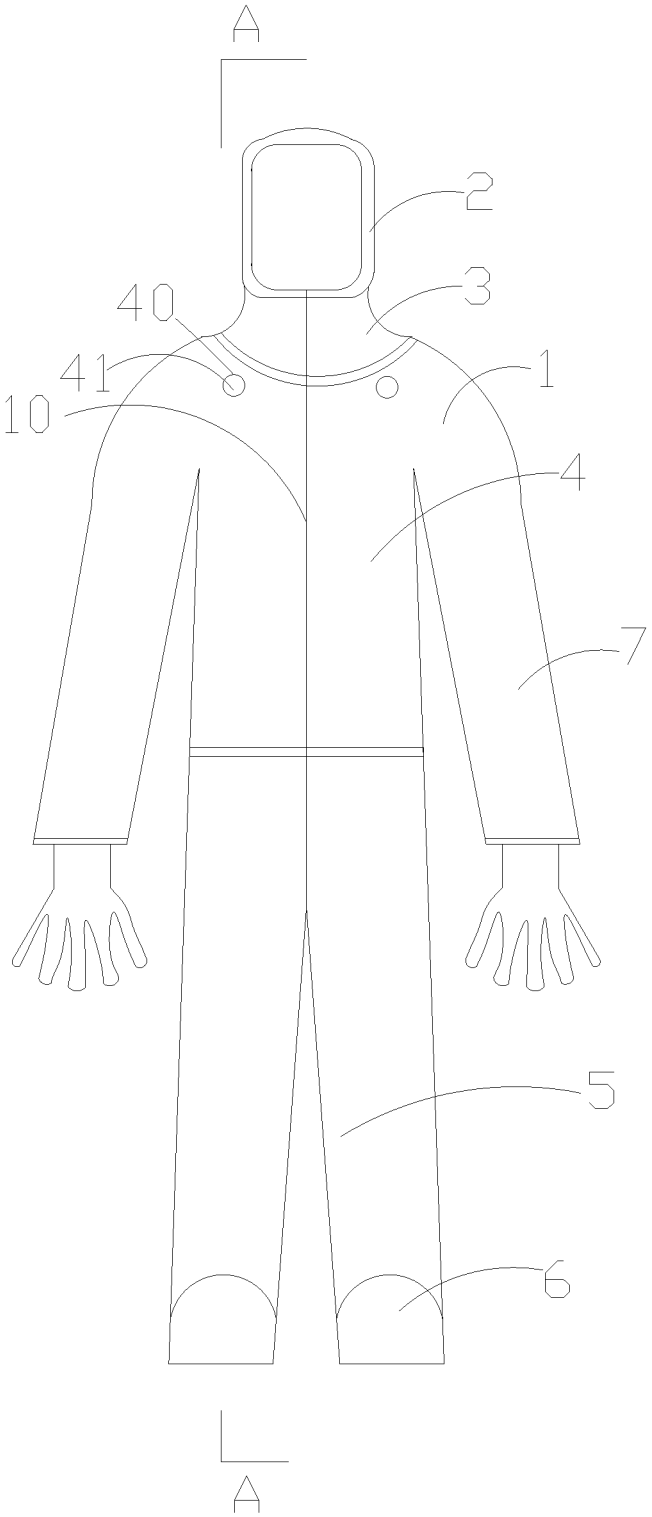
FIG. 1 is a structure diagram of disposable medical protective clothing in accordance with the present disclosure.
Figure 2:
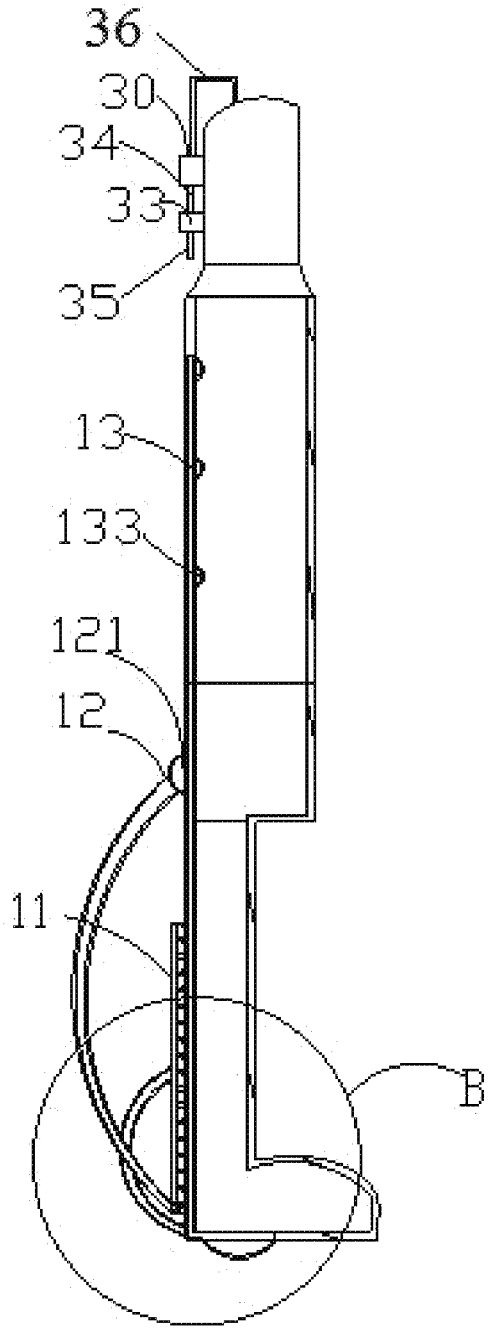
FIG. 2 is a sectional view at A-A of disposable medical protective clothing in accordance with the present disclosure.
Figure 3:
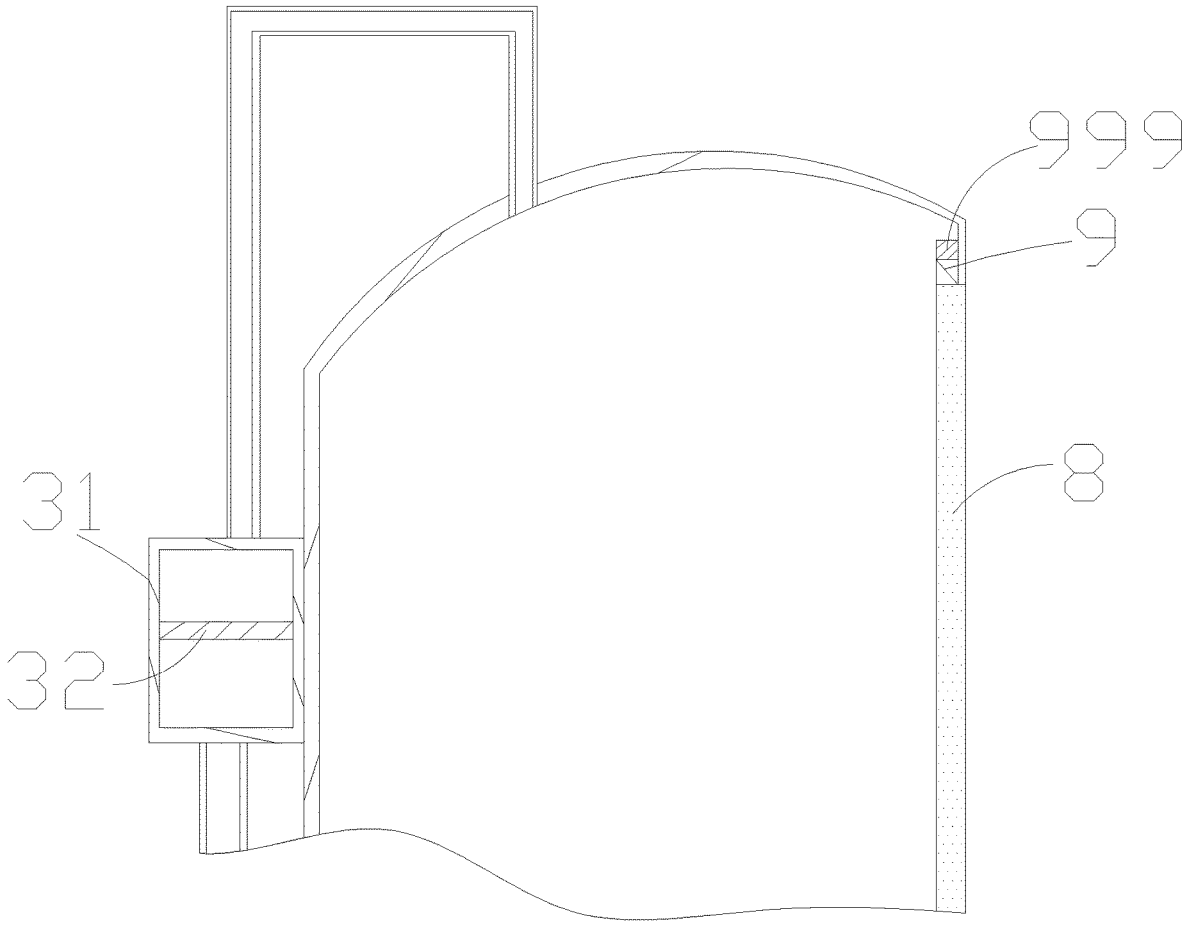
FIG. 3 is a schematic diagram of an internal structure of a hood part 2.
Figure 4:
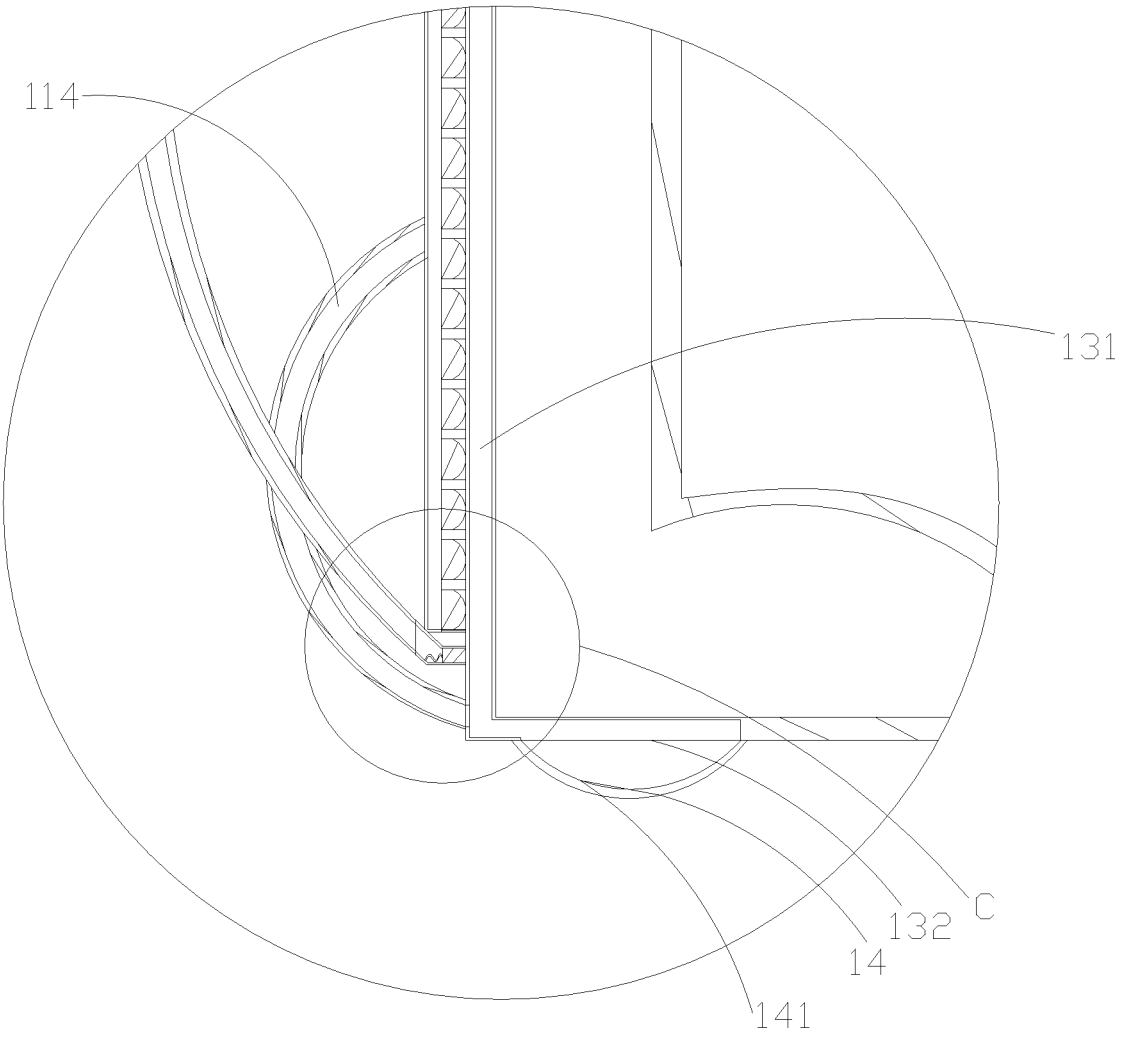
FIG. 4 is an enlarged view at B in FIG. 2.
Figure 5:
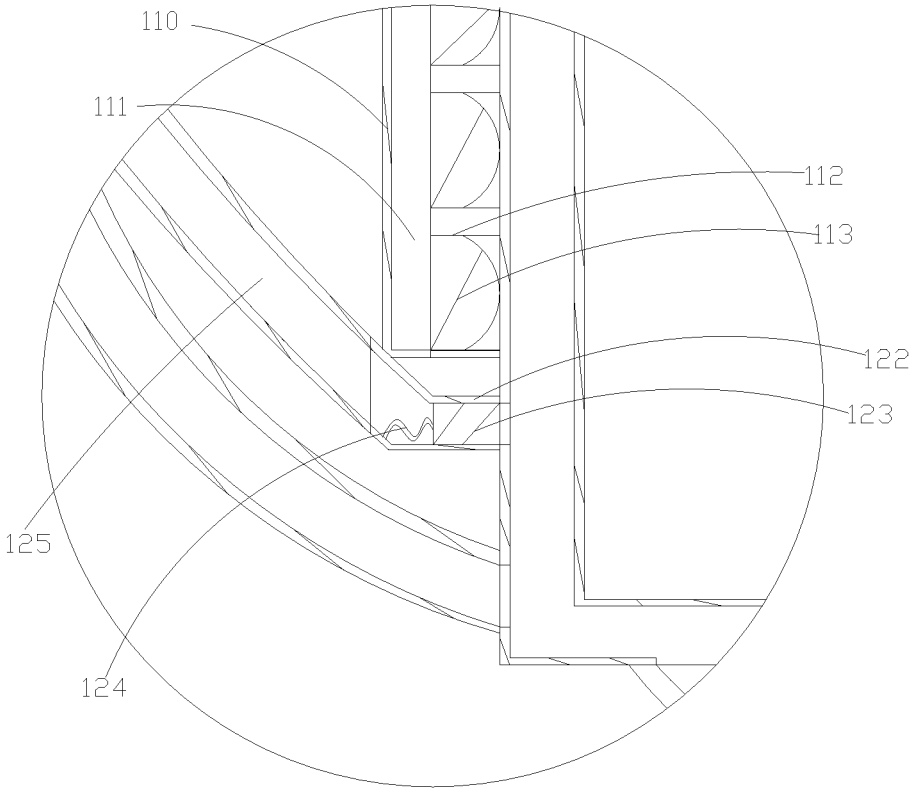
FIG. 5 is an enlarged view at C in FIG. 4.

The present disclosure is further illustrated below with reference to FIG. 1 to FIG. 5 and embodiments.

As shown in FIG. 1, FIG. 2, FIG. 3, FIG. 4 and FIG. 5, technically improved medical protective clothing comprises a protective clothing body 1. The protective clothing body 1 comprises a hood part 2, a neck part 3, a top 4, pants 5, shoe cover parts 6, and sleeves 7, and is formed by sewing the hood part 2, the neck part 3, the top 4, the pants 5, the shoe cover parts 6 and the sleeves 7 in sequence. The hood part 2 is provided with an air exchange assembly 30. The hood part 2, the top 4 and the pants 5 are provided with a sealing zipper 10. A transparent mask 8 is buckled in the hood part 2, a heating wire 9 is fixedly arranged at the inner side of the hood 2, and a battery 999 is fixedly arranged at the inner side of the hood part 2. The battery 999 is connected to the heating wire 9 by a wire; the left side and the right side of the pants 5 are respectively provided with a massage assembly 11 and a conversion assembly 12. The top 4 is provided with a supporting assembly 13, and the bottom of the each shoe cover part 6 is provided with a power assembly 14. In accordance with the embodiment, there are two shoe cover parts, each of which is provided with a power assembly 14. The electric heating wire is provided to prevent the transparent mask from fogging to affect the line of sight, and the battery may employ a small flat battery to power the electric heating wire; and the mask is made of a transparent material.

The power assembly 14 comprises a first airbag 141, and the airbag 141 is fixedly arranged at the bottom of the shoe cover part 6.

The supporting assembly 13 is provided with a ventilation cavity 131 and an air inlet 132, and comprises airbag ribs 133. The ventilation cavity 131 is located at the sidewalls of the shoe cover part 6, the pants 5 and the top 4. The air inlet 132 is located at the bottom of the shoe cover part 6 and communicates with the ventilation cavity 131. The airbag ribs 133 are located at the inner side of the top 4 and communicate with the ventilation cavity 131.

The number of the airbag ribs 133 is three, and the three airbag ribs 13 are arranged along the height of the top 4.

The massage assembly 11 comprises a connecting plate 110 fixedly arranged at a shank side of the pants 5, and the connecting plate 110 is provided with an inner cavity 111 and a plurality of holes 112. The plurality of holes 112 are arranged in a height direction of the connecting plate 110 and communicate with the inner cavity 111. A massage protruding block 113 capable of hermetically moving back and forth is arranged in each hole 112. The inner cavity 111 and the ventilation cavity 131 are provided with a first connecting hose 114 in a communicating manner.

One end, facing the pants 5, of the massage protruding block 113 is circular arc.

The conversion assembly 12 comprises a second airbag 121 fixedly arranged at a hip side of the pants 5. A fixing pipe 122 is fixedly arranged at a heel side of the shoe cover part 6, and a push block 123 capable of moving back and forth is arranged in the fixing pipe 122. A spring 124 is fixedly arranged between the push block 123 and the sidewall of the fixing pipe 122, and a second connecting hose 125 is arranged between the fixing pipe 122 and the inner cavity 111 in a communicating manner. Through the arrangement of the conversion assembly, when the medical personnel sit on the chair, the second airbag at the hip side may be in contact with the chair, and is deflated by the chair, the air in the second airbag may move to the ventilation cavity 131 through the push block 123 of the second connecting hose 125, thus blocking the ventilation cavity 131. At the moment, the compressed air of the first airbag can only enter the inner cavity through the third connecting hose to push the massage protruding blocks to move, thus massaging the leg.

Rubber is fixedly arranged on one side face, facing the shoe cover part 6, of the push block 123. Through the arrangement of the rubber, the leg is prevented from feeling uncomfortable when the push block clings to the leg.

The air exchange assembly 30 comprises a filtering housing 31 fixed at the back side of head of the hood part 2, and an antivirus filter screen 32 is fixedly arranged in the filtering housing 31. An air intake pump 33 is fixedly arranged at the back side of head of the hood part 2, and a third connecting hose 34 is arranged between the air intake pump 33 and the inside of the filtering housing 31 in a communicating manner. An air intake pipe 35 is arranged on the air intake pump 33 in a communicating manner; a fourth connecting hose 36 is arranged between the inside of the hood part 2 and the inside of the filtering housing 31 in a communicating manner. The top 4 part is provided with two air outlets 40, and automatic air exchange valves 41 are fixedly arranged at the air outlets 40. After the air intake pump 33 is started, the air is sucked and then filtered by the anti-virus filter screen so as to be inhaled by the medical personnel, and the gas exhaled by the medical personnel can be discharged to the external through the automatic air exchange valves. The air inlet on the air intake pump 33 is also provided with an anti-virus filter screen to prevent the pathogenic bacteria in the air from entering the air intake pump 33.

The air intake pump is in cooperation with the automatic air exchange valves. The air is sucked into the hood part by the air intake pump, and the gas exhaled by the medical personnel in the hood part is discharged by the automatic air exchange valves, such that the pressure balance in the hood part is achieved, and the humidity in the hood part is not too high, making the medical personnel feel comfortable.

The present disclosure has the beneficial effects as follows:

In accordance with the present disclosure, the sidewall of the top 4 is separated from the back of the medical personnel by the airbag ribs 133, thus preventing the medical personnel from feeling hotter due to the fact that the protective clothing clings to the medical personnel when the protective clothing is worn for a long time in summer. When needing to sit on a chair to rest, the medical personnel can put both hands on a chair seat to upward the front ends of the feet, thus the first airbags 141 at the middle of the feet are off the ground to remove the air from the airbag ribs 133 and deflate the airbag ribs 133; and then the medical personnel can sit on the chair with the back clinging to the chair, and can sit comfortably.

When sitting on the chair, the medical personnel can press and hold the connecting plates with both hands, and then can continuously step on the ground by both feet to make the first airbags 141 be deflated after continuously making contact with the ground, thus the air can enter the inner cavity 111 through the second connecting hose to push massage protruding blocks to massage the legs.

In a case that the medical personnel do not want the top 4 to cling to the back completely due to hot during massage, the medical personnel can make the first airbags 141 at the middles of the feet not completely off the ground, and can sit on the seat after the first airbags restore half of the volume. Therefore, the remaining half of the volume of gas in the first airbags can allow the massage protruding blocks to move and make the top not completely cling to the back of the body.

The embodiments disclosed in the present disclosure are preferred embodiments, but are not limited thereto. Those of ordinary skill in the art can easily appreciate the spirit of the present disclosure and make different derivations and changes according to the above embodiments, and all of these derivations and changes are within the scope of protection of the present disclosure without departing from the spirit of the present disclosure.

What is claimed is:

1. A medical protective clothing, comprising a protective clothing body, wherein the protective clothing body comprises a hood part, a neck part, a top, pants, shoe cover parts, and sleeves, and the hood part, the neck part, the top, the pants, the shoe cover parts, and the sleeves are sewn together to form the protective clothing body;

the hood part is provided with an air exchange assembly; the hood part, the top and the pants are provided with a sealing zipper, a transparent mask is buckled in the hood part, a heating wire is fixedly arranged at an inner side of the hood part, and a battery is fixedly arranged at the inner side of the hood part;

the battery is connected to the heating wire by a wire; a left side and a right side of the pants are provided with a massage assembly and a conversion assembly; respectively;

the top is provided with a supporting assembly, and a bottom of each of the shoe cover parts is provided with a power assembly;

the power assembly comprises a first airbag, the first airbag is fixedly arranged at the bottom of each of the shoe cover parts;

the supporting assembly is provided with a ventilation cavity and an air inlet;

the supporting assembly comprises airbag ribs;

the ventilation cavity is located at sidewalls of the shoe cover parts, the pants and the top;

the air inlet is located at the bottom of each of the shoe cover parts and communicates with the ventilation cavity; and the airbag ribs are located at an inner side of the top and communicate with the ventilation cavity;

the number of the airbag ribs is three, and the three airbag ribs are arranged along a height of the top;

the massage assembly comprises a connecting plate fixedly arranged at a shank side of each leg of the pants, the connecting plate is provided with an inner cavity and a plurality of holes, the plurality of holes are arranged in a height direction of the connecting plate and communicate with the inner cavity;

a massage protruding block capable of hermetically moving back and forth is arranged in each of the plurality of holes; and the inner cavity and the ventilation cavity are provided with a first connecting hose in a communicating manner;

one end, facing the pants, of the massage protruding block is shaped as a circular arc;

the conversion assembly comprises a second airbag fixedly arranged at a hip side of the pants, a fixing pipe is fixedly arranged at a heel side of each of the shoe cover parts, and a push block capable of moving back and forth is arranged in the fixing pipe;

a spring is fixedly arranged between the push block and a sidewall of the fixing pipe, and a second connecting hose is arranged between the fixing pipe and the inner cavity in a communicating manner;

rubber is fixedly arranged on one side face, facing the shoe cover parts, of the push block;

the air exchange assembly comprises a filtering housing fixed at a back side of the hood part;

an antivirus filter screen is fixedly arranged in the filtering housing, an air intake pump is fixedly arranged at the back side of the hood part, and a third connecting hose is arranged between the air intake pump and the inside of the filtering housing in a communicating manner;

an air intake pipe is arranged on the air intake pump in a communicating manner;

a fourth connecting hose is arranged between the inner side of the hood part and the inside of the filtering housing in a communicating manner; and the top part is provided with two air outlets, and automatic air exchange valves are fixedly arranged at the air outlets.

* * * * *